United States Patent [19]

Ohno

[11] Patent Number: 4,530,670

[45] Date of Patent: Jul. 23, 1985

[54] RECONFIGURABLE TOY

[75] Inventor: Kouzin Ohno, Tokyo, Japan

[73] Assignee: Takara Co., Ltd., Tokyo, Japan

[21] Appl. No.: 522,822

[22] Filed: Aug. 12, 1983

[51] Int. Cl.[3] ..... A63H 33/06

[52] U.S. Cl. ..... 446/94; 446/97; 446/435

[58] Field of Search ..... 46/17, 22, 103, 105, 46/115, 151, 201; 446/6, 85, 90, 93, 94, 95, 97, 99, 102, 289, 290, 376, 435, 465

[56] References Cited

U.S. PATENT DOCUMENTS

| | | | |
|---|---|---|---|
| 2,838,875 | 6/1958 | Hammond et al. | 46/201 |
| 4,051,623 | 10/1977 | Ogawa | 46/103 |
| 4,051,624 | 10/1977 | Ogawa | 446/445 |
| 4,170,840 | 10/1979 | Ogawa | 446/95 |
| 4,183,173 | 1/1980 | Ogawa | 446/94 |
| 4,206,564 | 6/1980 | Ogawa | 446/94 |
| 4,214,402 | 7/1980 | Ogawa | 446/90 |
| 4,248,006 | 2/1981 | Jones et al. | 46/17 |
| 4,382,347 | 5/1983 | Murakami | 46/201 |
| 4,391,060 | 7/1983 | Nakane | 46/201 |
| 4,393,620 | 7/1983 | Murakami | 46/201 |
| 4,435,916 | 3/1984 | Iwao et al. | 46/201 |

*Primary Examiner*—Robert E. Bagwill
*Assistant Examiner*—Daniel Nolan
*Attorney, Agent, or Firm*—Joseph W. Price

[57] ABSTRACT

A reconfigurable toy is provided that can simulate a van truck. The upper housing assembly or van body portion is removably attached to a lower frame assembly. The van body portion can be reconverted into a secondary vehicle. The lower frame assembly can be reconverted into a robotic figure to provide independent play action.

5 Claims, 9 Drawing Figures

RECONFIGURABLE TOY

DETAILED DESCRIPTION OF THE INVENTION

The present invention relates to a reconfigurable toy and more particularly to a reconfigurable toy which has a configuration simulating a vehicle as a whole and effects such an unexpectedly great reconfiguration that when the vehicle is disassembled into a lower frame member portion and a housing member portion, the lower frame member side can be transformed into a robot, while the housing member side can be transferred into a fortress.

An embodiment of the invention will be described herein with reference to the accompanying drawings.

BRIEF DESCRIPTION OF THE DRAWINGS

The accompanying drawings show an embodiment of the invention, in which.

Figure 1:
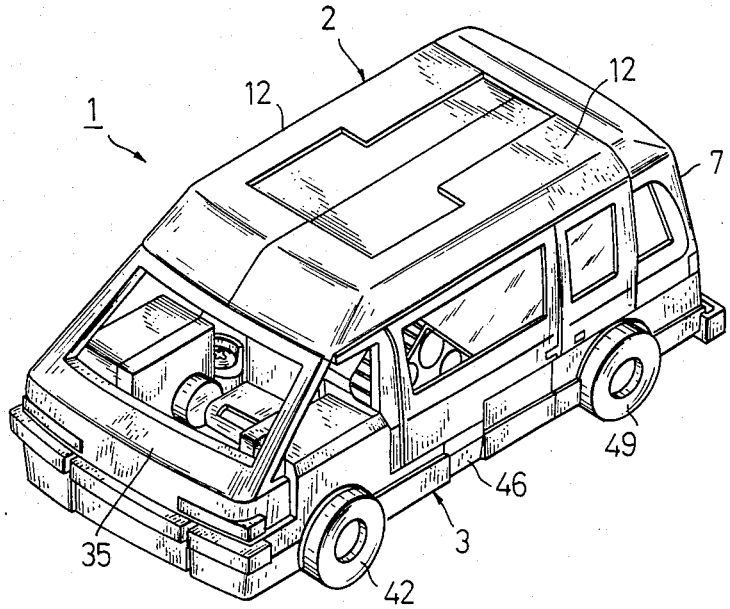
FIG. 1 is a perspective view of the whole of the embodiment before reconfiguration.
Figure 2:
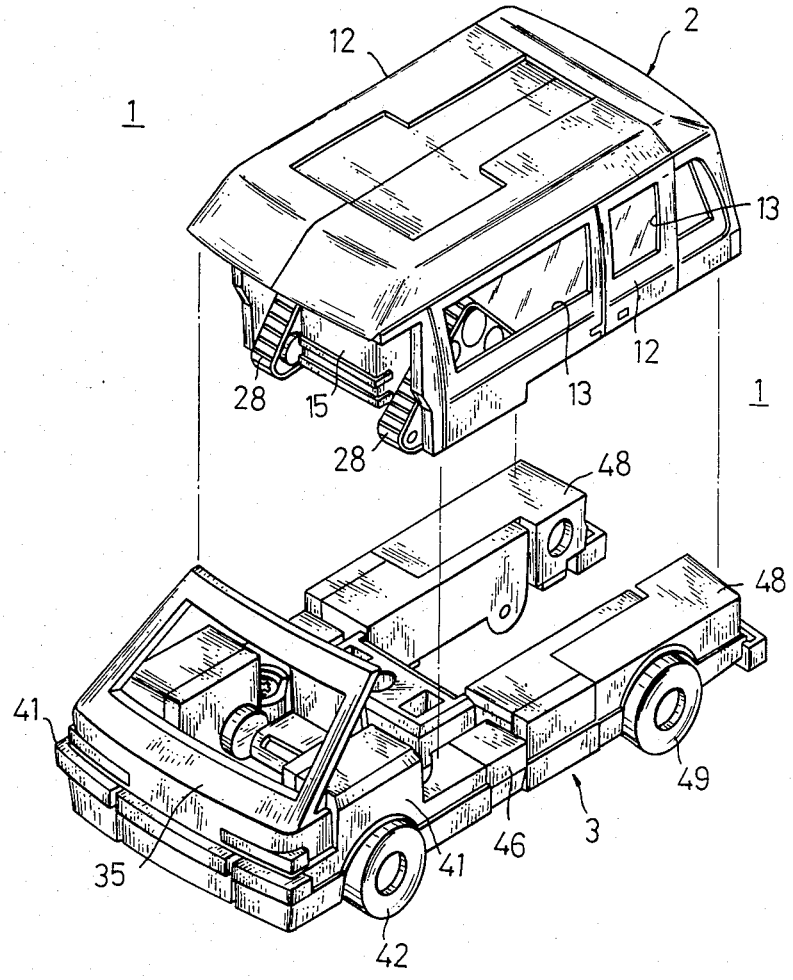
FIG. 2 is a perspective view of the whole of the embodiment in the state where the housing and the lower frame member are separate from each other.

A reconfigurable toy 1 according to the invention has a configuration which simulates a vehicle as a whole, as shown in FIGS. 1 and 2, and is constituted by a housing member 2 and a lower frame member 3, which are detachable.

The structure of each of the portion of the housing member 2 and the lower frame member 3 will be described hereinunder in detail.

Figure 3:
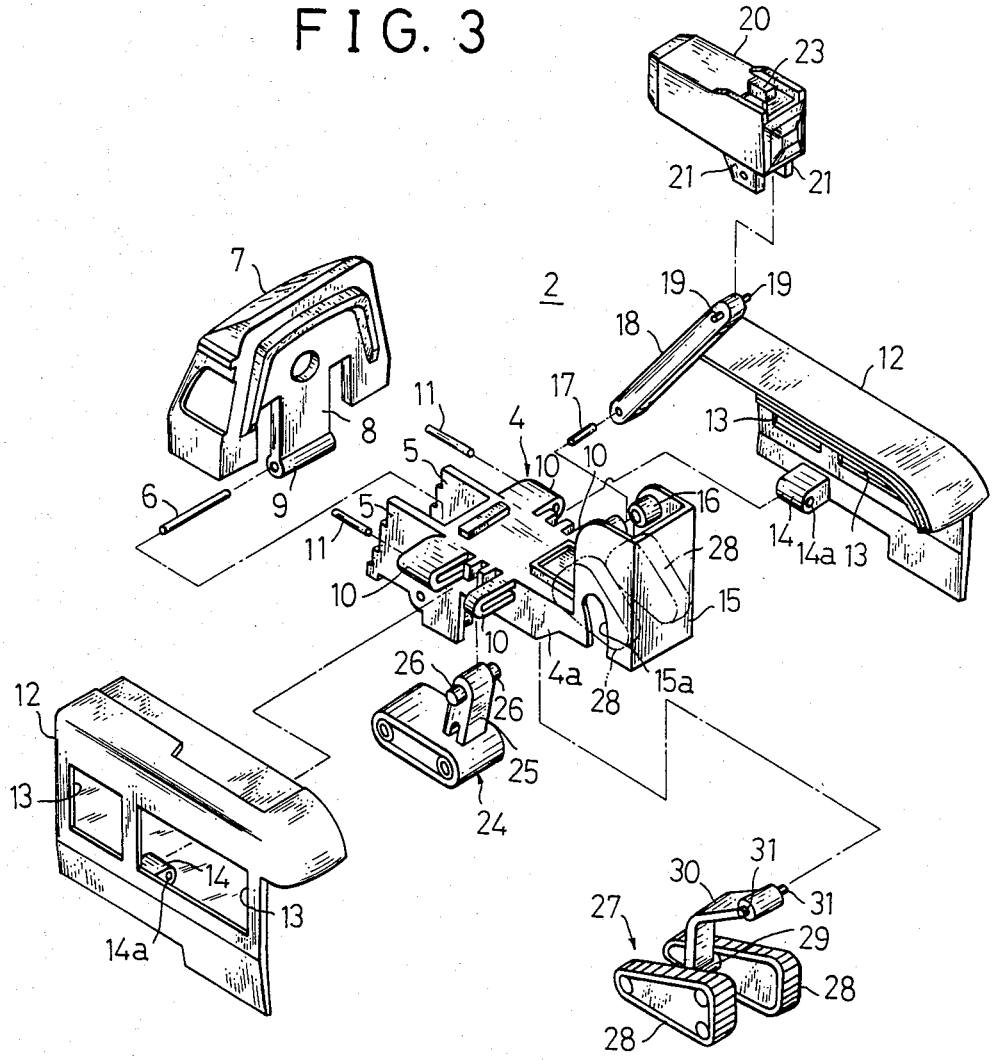
FIG. 3 is an exploded perspective view of the housing member.

The housing member 2 is assembled on the basis of a base frame 4, as shown in FIG. 3, which is an exploded view. A pair of right and left projecting members 5, 5 are provided on the rear side of the base frame 4. Between the projecting members 5, 5, a rear panel 7 is pivotably supported through a shaft 6. The rear panel 7 has on its rear surface a downwardly projecting member 8. A bearing portion 9 is formed at the lower end of the projecting member 8, and the shaft 6 is pivotably fitted in the bearing portion 9.

Each of the right and left sides of the base frame 4 has a pair of substantially U-shaped bearing portions 10, 10 projected bisymmetrically. Right and left side plates 12, 12 forming the housing member, are pivotably supported through shafts 11 fitted between these bearing portions 10, 10. Each side plate 12 has windows 13, 13 and an inwardly projecting member from its lower end portion thereof. The projecting member 14 is fitted between the bearing portions 10, 10, and the shaft 11 is fitted in a through-hole 14*a* formed in each projecting member 14, thereby allowing the side plates 12, 12 to be pivotably supported.

Figure 4:
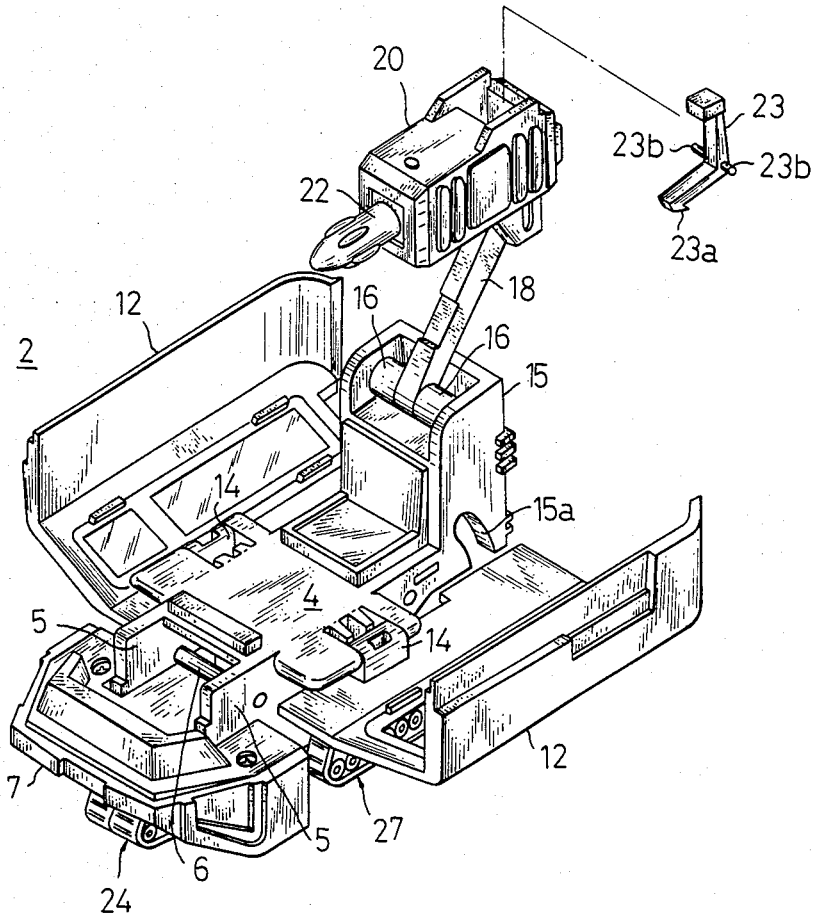
FIG. 4 is a perspective view of the housing member after reconfiguration.

The base frame 4 has a support frame 15 projecting from the front end portion thereof and having a U-shaped cross-section, opened forwardly and upwardly. The lower end of a pivoting lever 18 is pivotably supported through a shaft 17 by bearing portions 16, 16 projected from the inner side surfaces of the right and left side plates of the support frame 15. Pins 19 are projected from both sides of the upper end portion of the pivoting lever 18. Brackets 21, 21 projected from the lower end of a launcher 20, are pivotably supported by the pins 19, 19. The launcher 20 has a coiled spring housed therein. As shown in FIG. 4, an object 22 to be launched which simulates a missile or the like is loaded in the launcher from its rear end, and a recess (not shown) formed in the intermediate portion of the object 22 to be launched is engaged by a hook 23*a* formed at an end portion of a push-button lever 23, thereby allowing the object 22 to be locked. The push-button lever 23 is formed in, for example, an L-shape as shown in FIG. 4, and is pivotably mounted in the launcher through pins 23*b* projected from both sides of the bent portion of the push-button lever 23.

Figure 5:
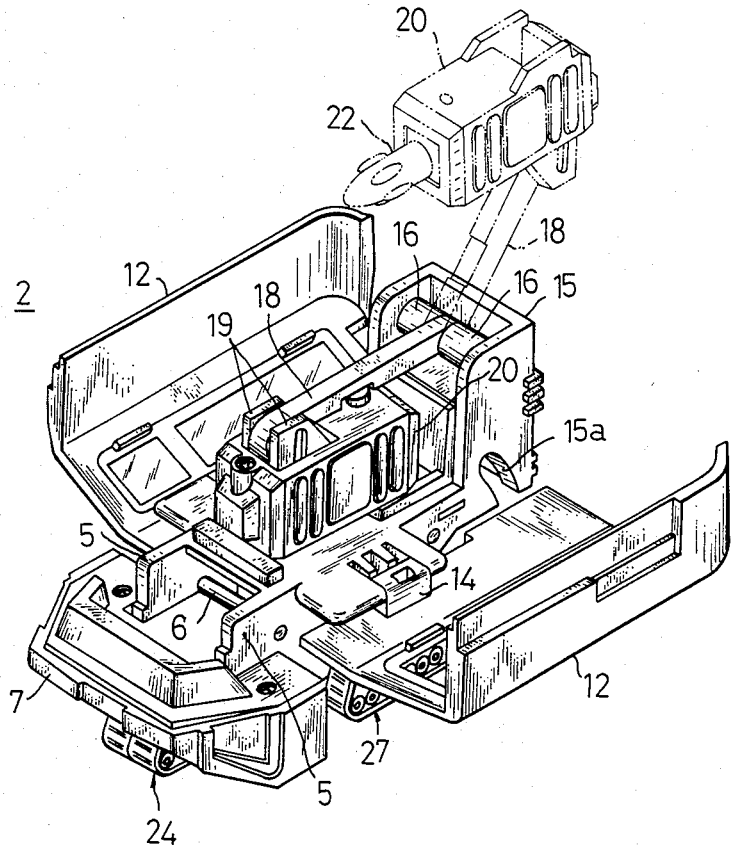
FIG. 5 is a perspective view of a launcher in its folded and unfolded states.

In addition, the launcher 20 is able to change its state: from the state where it is positioned at the upper end portion of the pivoting lever 18, into the state where the launcher 20 is folded and mounted on the base frame 4 as shown in FIG. 5. In such a case, it is only necessary to pivot the launcher 20 itself about the pins 19 as well as pivot the pivoting lever 18 so that it becomes parallel to the base frame 4.

Figure 6:
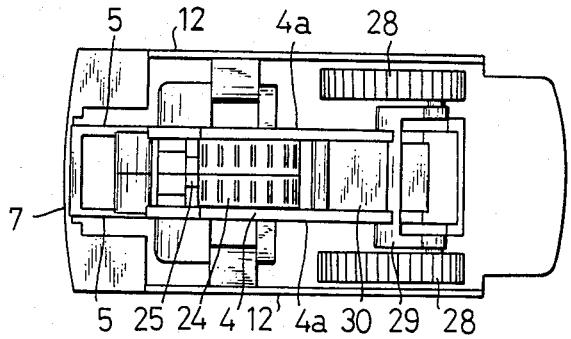
FIG. 6 is a bottom view of the housing member.

On the other hand, a first crawler 24 is pivotably attached by utilizing the space between the lower portions of the end portions of the respective projecting members 5, 5 of the base frame 4. The crawler 24 is formed simulating what is called a caterpiller, and has a support shaft 25. The crawler 24 is pivotably supported through pins 26 projected from both sides of the upper end of the support shaft 25. Accordingly, the crawler 24 can be changed in position, from the state shown in FIG. 3 to the state where it is housed between the right and left side plates 4*a* of the base frame 4 by pivoting the crawler counterclockwise about the pins 26. The housed state is shown in FIG. 6.

On the other hand, a reference numeral 27 denotes a second crawler. The second crawler 27 has a pair of right and left crawlers 28, 28, which are connected together with a shaft 29 so that the crawlers 28, 28 are maintained parallel to each other. The shaft 29 is connected with the lower end of an arm 30 bent in a substantially L-shape. Pins 31, 31 are projected from the right and left sides of the upper end of the arm 30 and are pivotably supported at a forward position between the right and left side plates 4*a* of the base frame 4. The distance between the right and left crawlers 28, 28 is larger than the width of the support frame 15 projected from the end portion of the base frame 4. When the arm 30 is pivoted counterclockwise about the pins 31 as viewed in FIG. 3, both end portions of the shaft 29 are received by notches 15*a* formed circularly and upwardly from the lower end of the support frame 15, causing the right and left crawlers 28 to be positioned on both sides of the support frame 15. Under such a housed state, as shown in FIG. 6, the crawlers 28 are positioned between the base frame 4 and the right and left side plates 12 respectively, and consequently, are completely housed on the side of the base frame 4, together with the first crawler 24.

Since the housing member 2 is arranged as described above, when the side plates 12, 12 are closed and the rear panel 7 is upright, the launcher 20, together with the pivoting lever 18, are on the base frame 4, and the first and second crawlers 24, 27 are housed on the lower side of the base frame; hence, the housing member 2 has a configuration as only a housing member.

However, if the first and second crawlers 24, 27 are downwardly projected before the right and left side plates are opened, and then the right and left side plates 12, 12 are opened and the rear panel 7 is forwardly laid down and moreover the launcher 20 is projected, then the housing member 2 can be transformed into a fortress or a moving vehicle platform with a simulated gun, which is completely different from a housing member, as shown in FIGS. 4 and 5.

Figure 7:
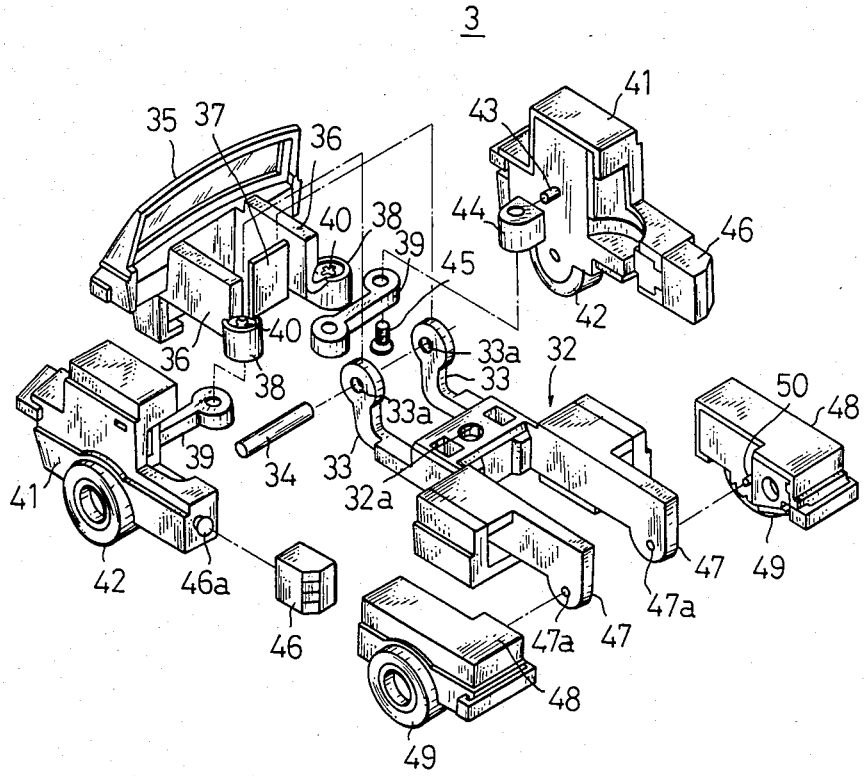
FIG. 7 is an exploded perspective view of the lower frame member.

On the other hand, the lower frame member 3 is arranged as shown in FIG. 7, which is an exploded view.

More specifically, as shown in FIG. 7, the lower frame member 3 is assembled on the basis of a bisymmetrically formed frame 32 with a pair of rear frame portions. The frame 32 has at its front end right and left arms 33, 33 which are bent so as to extend forwardly as well as upwardly. A front panel 35 is pivotably supported by a shaft 34 fitted in through-holes 33*a* formed in the front end portions of the respective arms 33. The front panel 35 has a pair of right and left projecting members 36 formed in the lower portion thereof on the inner surface side, and the shaft 34 is pivotably supported between the projecting members 36. A seat 37, formed integrally with the front panel 35, is disposed between the projecting members 36, 36.

A cylindrical bearing portion 38 is integrally formed in the lower portion of the rear end portion of each of the projecting members 36, 36 of the front panel 35. One end of a pivoting lever 39 is pivotably supported by each bearing portion 38 by means of a screw 40.

Each of the side frames 41, 41 are pivotably connected to the other end side of the corresponding pivoting lever 39. Each side frame 41 has a configuration as a frame constituting a part of either side of the front end portion of the lower frame member 3 and is provided with a front wheel 42 rotatably supported. In addition, the left end portion of a block 44 is pivotably fitted on a pin 43 projected from the inner surface of each side frame 41. Each block 44 is pivotably attached to the outer end side of the corresponding pivoting lever 39 by means of a screw 45.

Accordingly, each of the side frames 41, 41 is able to freely pivot within two planes; a plane including the corresponding pivoting lever 39 and the inner plane of the side frame 41 perpendicular to the former plane, thereby to obtain a wide freedom of pivoting.

A spherical protrusion 46*a* forming a ball joint is projected from the rear end portion of each side frame 41. A block 46 simulating a fist is rotatably fitted on each protrusion 46*a*. Each block 46 is formed into a square block so as to constitute a part of the lower frame member.

On the other hand, a pair of right and left projecting members 47, 47 are projected from the rear end portion of the frame 32. The right and left rear frames 48 are pivotably supported by through-holes 47*a* formed in these projecting members 47, respectively. Each rear frame 48 has a rear wheel 49 rotatably supported and is itself pivotably supported by fitting its rotary shaft 50 into the corresponding through-hole 47*a*.

Since the lower frame member 3 is arranged as described above, under the condition before reconfiguration so that, the projecting members 36, 36 of the front panel 35 are horizontally disposed so as to be in the same plane as the frame 32. Under this state, the front end outer sides of the respective pivoting levers 33 are below the front panel 35 as well as inside the projecting members 36, 36, and the side frames 41 are parallel to the respective sides of the lower frame member. Also each block 46 is in the substantially central part of the corresponding side surface of the lower frame member, and the front wheels 42 are on the respective sides of the front panel 35 as shown in FIG. 2. In addition, also the rear frames 48 are arranged on a straight line so as to be outside the respective projecting members 47 of the frame 32. Accordingly, the lower frame member 3 has the configuration of a lower frame member of a vehicle as a whole, as shown in FIG. 2.

When the lower frame member 3 is desired to be transformed from this state, first, the right and left side frames 41 are positioned outside the frame 32 by pivoting the side frames 41 so that the ends of their respective pivoting levers 39 are pulled out toward both sides of the front panel 35 from the lower side thereof. Then, the front panel 35 is pivoted 90° forwardly as well as downwardly (in the counterclockwise direction as viewed in FIG. 7) about the shaft 34. As a result, the front panel 35 forms the head portion of a mechanical robot.

Next, when the side frames 41 are pivoted about the respective pins 43 so that the front wheels 42 are pointed toward the laid-down front panel 35 (in the clockwise direction as viewed in FIG. 7), the pivoting levers 39 form the shoulder portions of the robot, and the side frames 41 form the right and left arms of the robot. In addition, the blocks 46 become the fists of the right and left arms.

Figure 8:
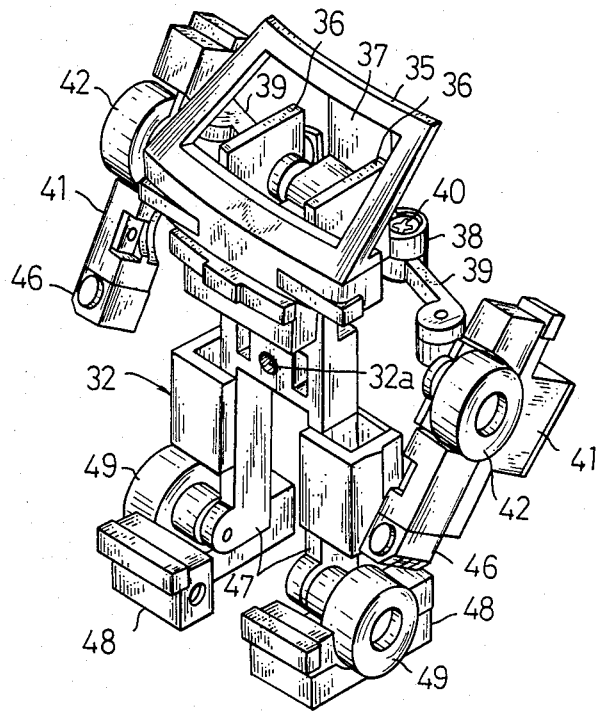
FIG. 8 is a perspective view of the lower frame member after reconfiguration.

Moreover, when the right and left rear frames 48 are pivoted about the shafts 50 in the clockwise direction as viewed in FIG. 7, so that the rear wheels 49 are on the upper side, the rear frames 48 form the foot portions of the robot as shown in FIG. 8.

Thus, the lower frame member of a vehicle is able to change into a robatic humanoid, which is completely different from the original lower frame member.

Figure 9:
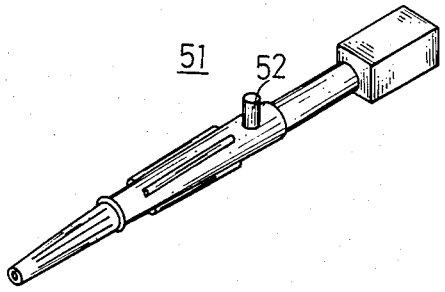
FIG. 9 is a perspective view of an accessory.

By the way, if a pin 52 projected from the upper surface of an accessory 51 simulating a ray gun or the like, such as shown in FIG. 9, is fitted in a through-hole 32*a* of the lower surface side formed through from the upper surface to lower surface of the central part of the frame 32, then it is possible to transform the toy into a fortress and a robot equipped with more weapons.

As will be fully understood from the foregoing description, the housing member and the lower frame member of the vehicle having a configuration simulating a running vehicle are arranged so as to be detachable, and the housing member is adapted to be able to change into a fortress equipped with a launcher and crawlers by utilizing the constituent parts thereof, while the lower frame member is adapted to be able to change into a mechanical robot. Therefore, it is possible to obtain a novel, reconfigurable toy which effects a large change that cannot be imagined from the state before reconfiguration.

I claim:

1. A reconfigurable toy comprising:

an upper housing assembly and a lower frame assembly that are removably connected together to form a configuration simulating a vehicle, the lower frame assembly includes a bifurcated frame member that respectively mounts a pair of pivotal side frame members that form the forward side portions of a vehicle in a first configuration and the arm appendages of a robot in a second configuration, a pair of pivotal rear frame members that form vehicle underframe sections in a first configuration and robot feet in a second configuration and a front panel member that forms a front portion of the vehicle in a first configuration and an upper portion of the robot in a second configuration, the upper housing assembly includes a pair of pivotal side plates that form the sides and top of a vehicle body in a first configuration and a portion of the floor and side walls of a secondary vehicle in a second configuration, a pivotal rear panel that forms a rear portion of a vehicle body in a first configuration and a front portion of a secondary vehicle in a second configuration wherein the upper housing assembly can be removed to create a secondary vehicle or work station and the lower frame assembly can be converted into a robot.

2. The invention of claim 1 wherein the upper housing assembly further includes a simulated launcher mounted on the upper side thereof and a plurality of simulated crawler treads pivotally housed for extension on the lower side thereof.

3. The invention of claim 1 wherein the upper housing assembly is configured to simulate a van body.

4. The invention of claim 1 wherein the pivotal side frame members support the front wheels of the vehicle.

5. The invention of claim 4 wherein the bifurcated frame member includes a pair of rear frame portions, each supporting a rear wheel and the pivotal rear frame members rotate about the respective rear wheels.

* * * * *